US006718570B2

(12) United States Patent
Brooks

(10) Patent No.: US 6,718,570 B2
(45) Date of Patent: Apr. 13, 2004

(54) CONVERTIBLE COUCH BED

(76) Inventor: Ralph J. Brooks, 9318 Fostoria St., Downey, CA (US) 90241

( * ) Notice: Subject to any disclaimer, the term of this patent is extended or adjusted under 35 U.S.C. 154(b) by 0 days.

(21) Appl. No.: 09/907,829

(22) Filed: Jul. 19, 2001

(65) Prior Publication Data

US 2003/0014814 A1 Jan. 23, 2003

(51) Int. Cl.[7] ..... A47C 17/14
(52) U.S. Cl. ..... 5/12.1; 5/31; 5/35; 5/36
(58) Field of Search ..... 5/12.1, 31, 35, 5/36, 37, 47

(56) References Cited

U.S. PATENT DOCUMENTS

| | | | | | |
|---|---|---|---|---|---|
| 2,642,584 | A | * | 6/1953 | Petersen et al. | 5/17 |
| 2,723,401 | A | * | 11/1955 | Brede-Horst | 5/37.1 |
| 3,346,889 | A | * | 10/1967 | Gran | 5/12.1 |
| 3,857,120 | A | * | 12/1974 | Acker | 297/440.2 |
| 4,173,045 | A | * | 11/1979 | Osborn | 5/118 |
| 4,481,684 | A | * | 11/1984 | Hauck | 5/18.1 |

* cited by examiner

*Primary Examiner*—Teri Pham Luu
*Assistant Examiner*—Fredrick Conley
(74) *Attorney, Agent, or Firm*—Albert O. Cota

(57) ABSTRACT

A convertible couch bed that consists of a frame (20) that has a pair of opposed ends (22) with each end having a horizontal upper surface (24), an arm (26) and a plurality of legs (28). The frame includes a pair of lower longitudinal supports (30) and a upper longitudinal support (32) attached between the ends. A mattress support structure (34) is positioned between the ends and sustained by the lower longitudinal supports and a mattress (36) is positioned on the support structure forming a comfortable seat for sitting on the front portion. An upholstered top (38) covers the rear portion of the mattress and is attached to the frame with a piano hinge (44). An upholstered back (48) is attached to the top allowing the back to fold upward in accordion fashion and rest upon the frame thereby permitting conversion of the couch into a bed by exposing the entire mattress therefore forming a bed suitable for sleeping. A second embodiment differs in that the mattress has two separate sections hingeably attached together such that when they are pivoted side by side in a flat position they form a king size bed.

15 Claims, 7 Drawing Sheets

CONVERTIBLE COUCH BED

TECHNICAL FIELD

The present invention relates to couch's in general. More specifically to a couch that utilizes a mattress for a seat with a upholstered back that folds up against a hinged top exposing the entire mattress forming a bed suitable for sleeping.

BACKGROUND ART

Previously, many types of convertible couches or sofa beds have been used in endeavoring to provide both a couch for sitting and a bed for sleeping, with minimal effort to make the changeover.

A search of the prior art did not disclose any patents that possess the novelty of the instant invention, however the following U.S. patents are considered related:

| U.S. Pat. No. | Inventor | Issue Date |
|---|---|---|
| 5,271,109 | Markel et al. | Dec. 21, 1993 |
| 5,394,573 | Laughlin et al. | Mar. 7, 1995 |
| 5,644,804 | Wang | Jul. 8, 1997 |
| 5,815,857 | De Lorenzo | Oct. 6, 1998 |
| 5,920,928 | Piretti | Jul. 13, 1999 |

Markel et al. in U.S. Pat. No. 5,271,109 teaches a convertible sofa-bed that has a support frame and a seat support that is slideably connected to the frame by a roller and a back support which is pivotally connected to the seat support. The back support includes a hook apart which provides for connection of the back to the seat.

U.S. Pat. No. 5,394,573 issued to Laughlin et al. is for a sofa bed that is upholstered and includes a frame in sections. A platform is provided that is retractable with a hinge member attaching the front platform section to a back platform at an obtuse angle in one configuration and hinges flat in another. The front platform includes at least one support leg.

Wang in U.S. Pat. No. 5,644,804 discloses a sofa bed which includes a base frame serving as the seat and covers a space for keeping pillows etc. A second base frame connects to the first and pivots to the desired angle to serve as the back of the sofa and a pair of armrests are adjustably connected to the base frame at two opposite ends.

De Lorenzo in U.S. Pat. No. 5,815,857 teaches a fixed structure with three movable frames in engagement with each other in a consecutive rotatable manner and are shiftable between a closed and open position. A kinematic driving mechanism is interposed between the frames and synchronization means are adapted to move the frames in a single operation.

U.S. Pat. No. 5,920,928 issued to Piretti is for a sofa that may be converted into a bed by drawing the supporting structure until it reaches an elongated condition in which the mattress lies flat. In the retracted condition, for use as a sofa, the mattress is folded under the supporting structure.

DISCLOSURE OF THE INVENTION

In the past convertible couches or sofas include rather complex frames and movable structure to permit a rather thin mattress to be folded under the seat of the couch with the back swinging upwardly out of the way and the mattress unfolded away from the couch to form the bed. Many different embodiments of this basic piece of furniture have been developed and are very common in today's marketplace. While economies of number have brought this type of product within the reach of most, the fact that the structure is complicated, in that a large number of frame parts are required, increases the cost above that of a traditional sofa or couch. It is therefore a primary object of the invention to employ a conventional single bed mattress, with upholstery material outer covering, and use the front portion for the seat of the couch with a back and top hinged to fold in accordion fashion out of the way exposing the entire mattress when used as a bed.

This permits an important object of the invention to be realized as the cost of an elaborate frame that pivots the seat flat into a bed is eliminated and is replaced with two simple inexpensive piano hinges which simplify the structure and allow the overall couch construction to be uncomplicated and cost effective.

Another object of the invention is that a conventional single bed mattress is used for both the seat and the bed which is comfortable in both functions, as the mattress includes coil springs and has been designed basically for sleeping therefore no minimizing of size or comfort has been necessary that would degrade its utility in either mode.

An important object of the invention is in the second embodiment wherein the mattress instead of being discrete is in two separate sections each having the same overall size as a twin bed mattress except they are connected together on one edge. When the mattress is folded over on top of each other they form the seat of the couch and when rotated upward and spread out flat they become a king size bed supported by a portable frame that is stored under the couch.

Still another object of the invention is that it is easy to operate as the back is simply raised up by hand and the top folds against the wall behind or is stopped by the structure of the frame. No latch or complicated mechanism is required as the top and back are over the center of gravity or rest upon rigid structure.

Yet another object of the invention is that the sofa may be dissembled by removing the longitudinal support from each end with the mattress support structure and mattress separated while the top and back are still connected together with the hinges. Reassembly is easy to accomplish and storage and transportation is enhanced by the having only flat components to handle consuming considerably less space than a common sofa or couch.

A further object of the invention is that the style of the couch may be easily altered and still function in the same manner, as an example the ends may be open exposing the structural wood or may be enclosed with fabric material in a variety of shapes to accommodate the style that is most desired.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
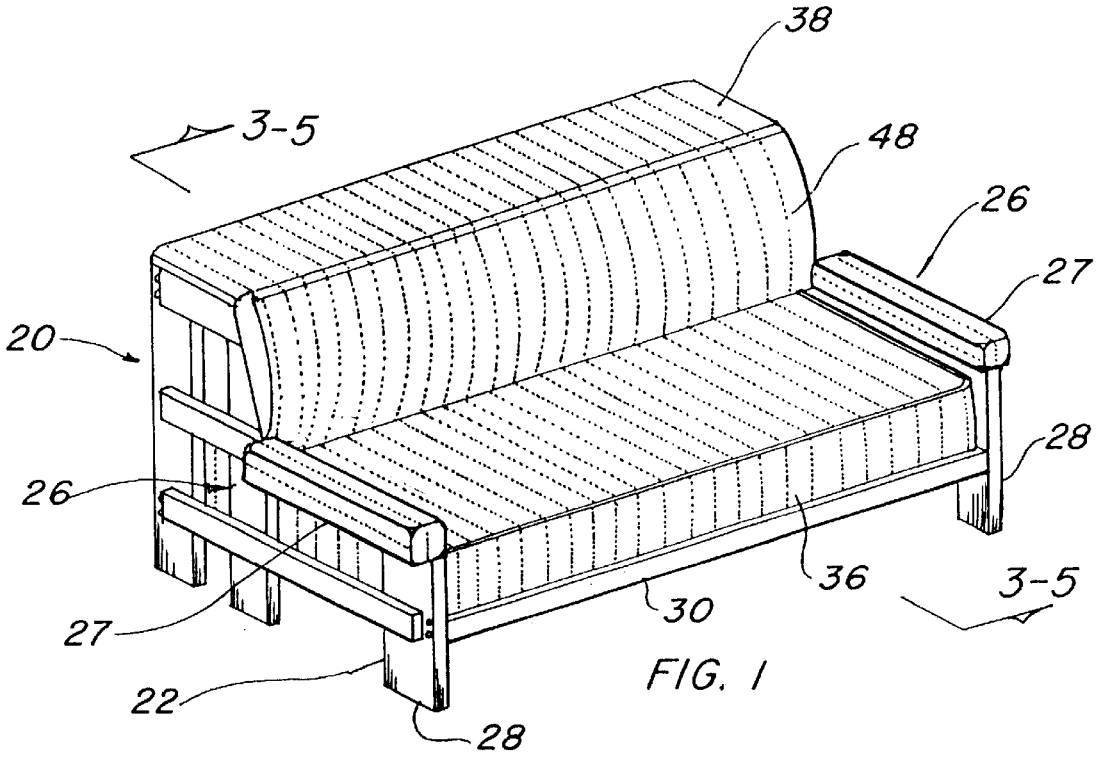
FIG. 1 is a partial isometric view of the preferred embodiment in the couch configuration for sitting.
Figure 2:
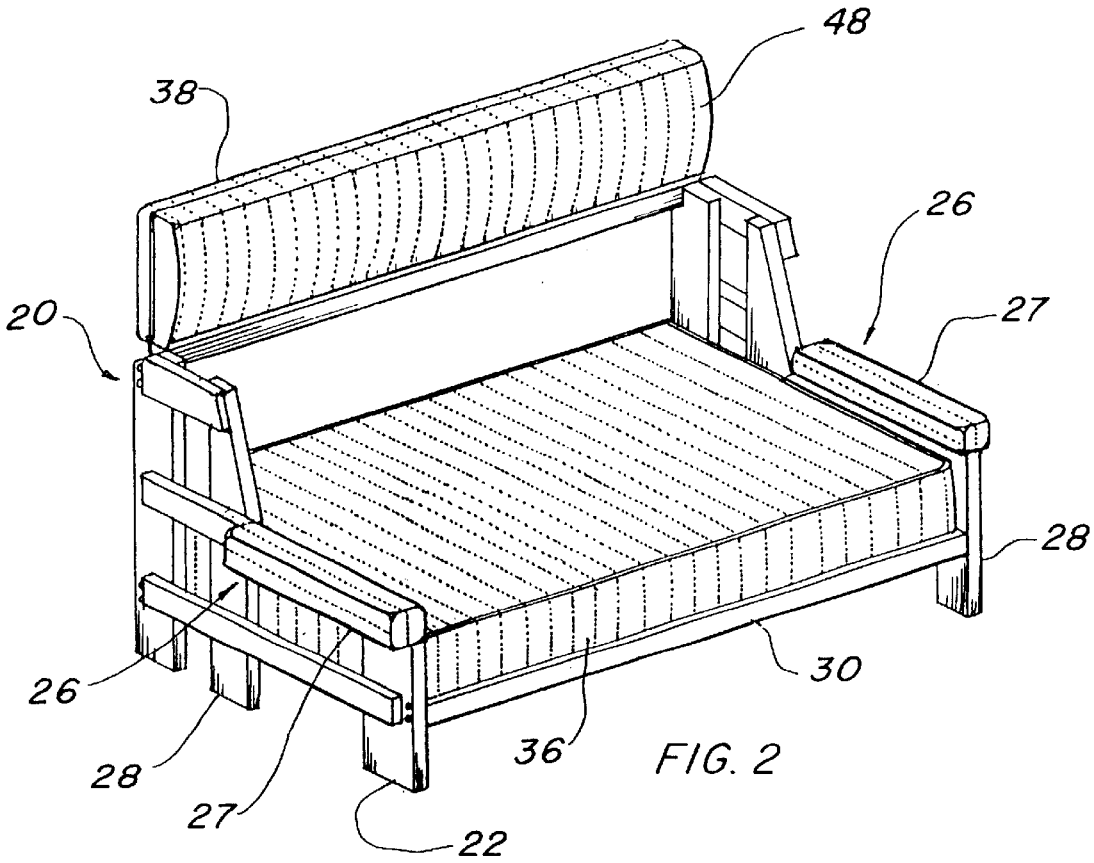
FIG. 2 is a partial isometric view of the preferred embodiment in the bed configuration for sleeping.

The best mode for carrying out the invention is presented in terms of a preferred and a second embodiment. This preferred embodiment is shown in FIGS. 1 thorough 12 and is comprised of a frame 20 that consists of a pair of opposed ends 22 with each end having a horizontal upper surface 24, an arm 26 and a plurality of legs 28. The frame 20 further includes longitudinal support means in the form of at least a pair of lower longitudinal supports 30 attached between the ends 22 and a upper longitudinal support 32 attached between the ends 22 adjacent to the upper surface 24. The ends 22 are preferably detachable from the upper supports 32 and the lower supports 30 for ease of transportation and storage.

Figure 13:
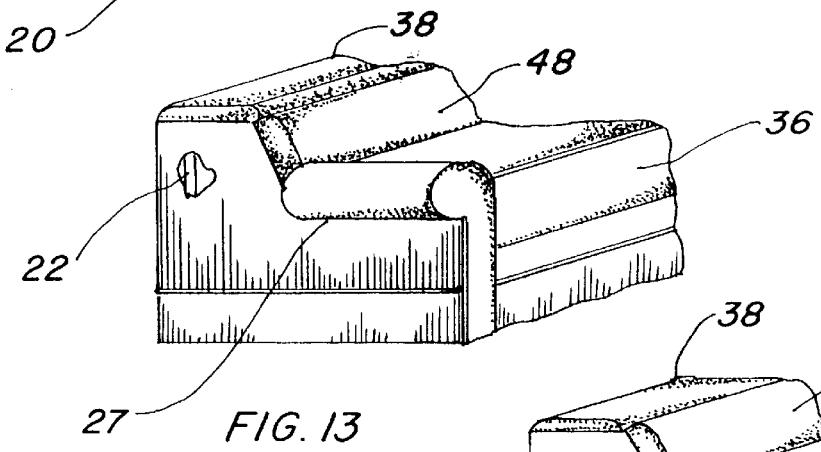
FIG. 13 is a fragmentary isometric view of the couch in a second embodiment.
Figure 14:
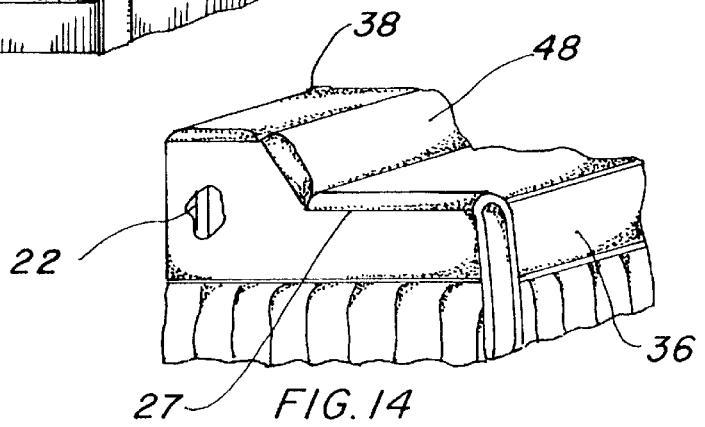
FIG. 14 is a fragmentary isometric view of the couch in another configuration of the second embodiment.
Figure 15:
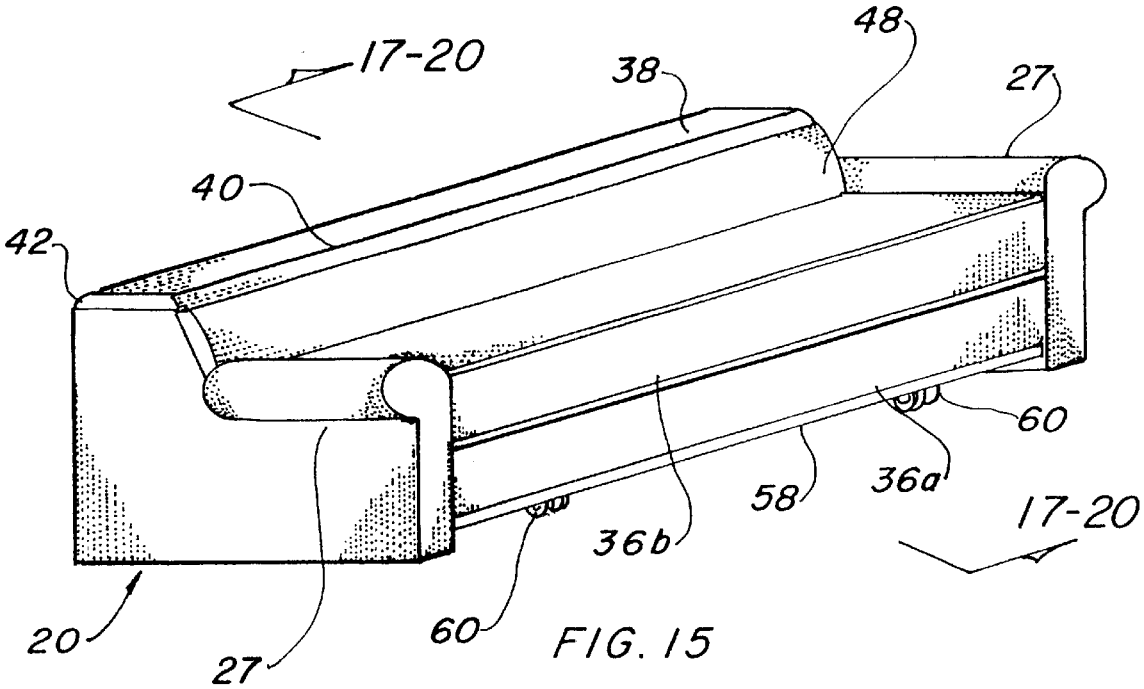
FIG. 15 is a partial isometric view of the second embodiment in the couch configuration for sitting.
Figure 16:
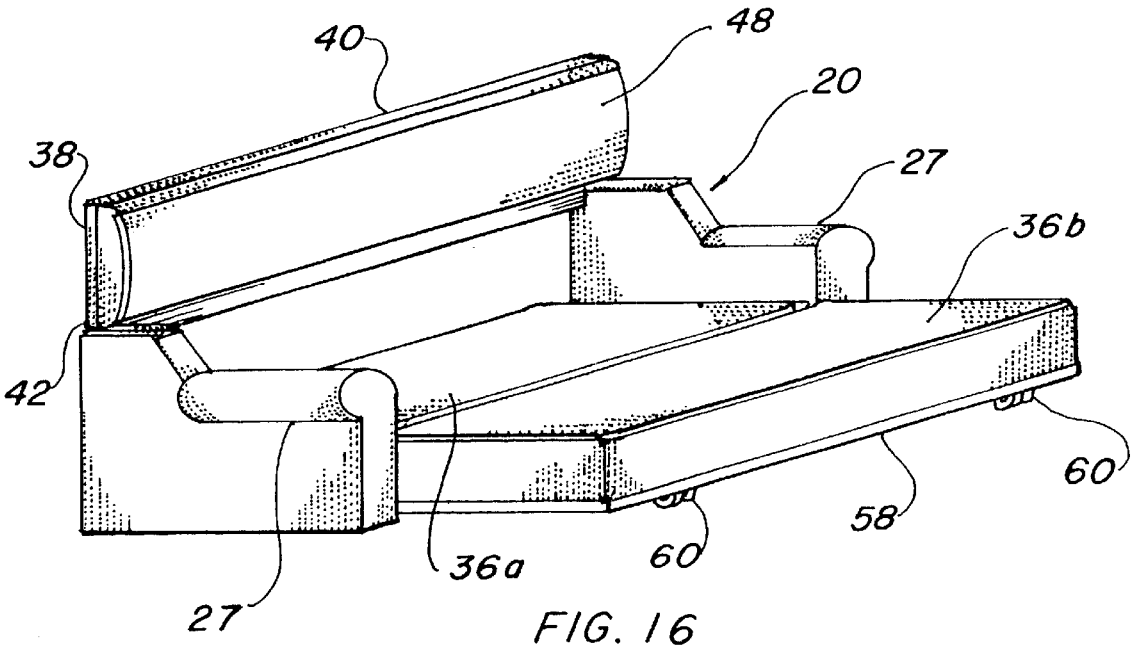
FIG. 16 is a partial isometric view of the second embodiment in the bed configuration for sleeping with the mattress pivoted open and resting on the mattress support structure.
Figure 17:
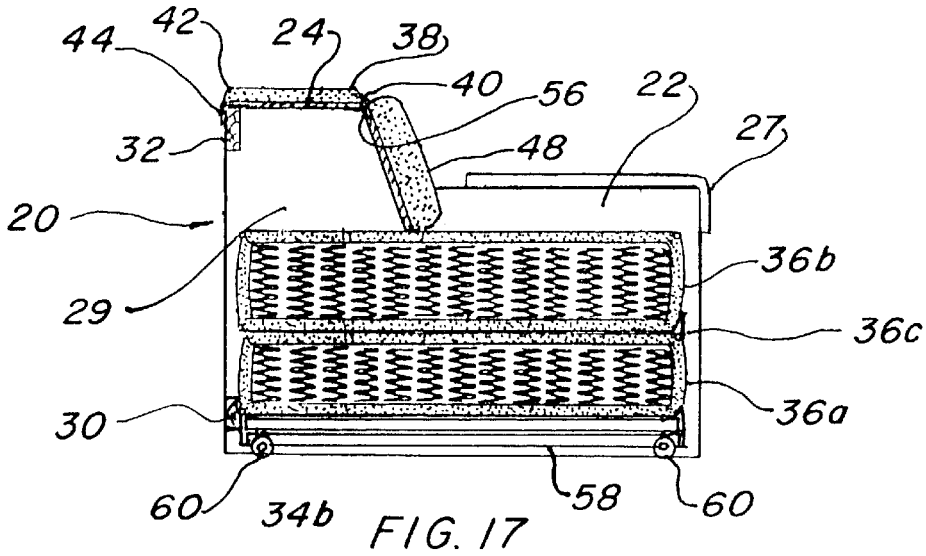
FIG. 17 is a cross sectional view of the second embodiment taken along lines 17—17 of FIG. 15 in the couch configuration for sitting.
Figure 18:
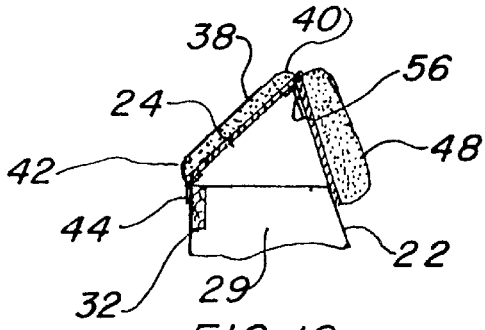
FIG. 18 is a cross sectional view of the second embodiment taken along lines 18—18 of FIG. 15 with the top and back partially raised up.
Figure 19:
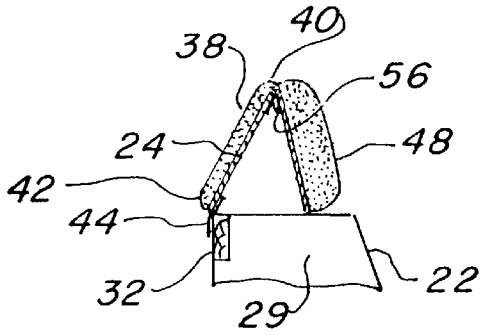
FIG. 19 is a cross sectional view of the second embodiment taken along lines 19—19 of FIG. 15 with the top and back raised up almost to the vertical position.
Figure 20:
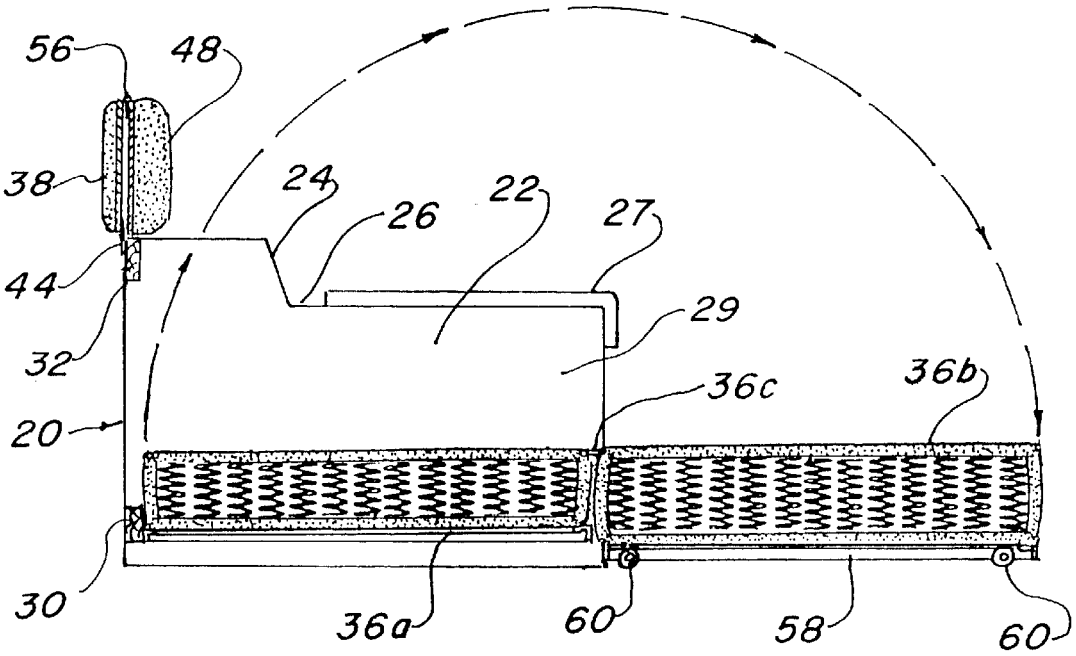
FIG. 20 is a cross sectional view of the second embodiment taken along lines 20—20 of FIG. 15 with the top and back raised up in the vertical position for the bed configuration and the mattress pivoted open into the king size bed arrangement.

The frame 20 is constructed of wood, as shown, however other materials may also be utilized such as metal and their use will still be within the scope of the invention. The arms 26 may include a padded and upholstered arm rest 27 disposed on each frame arm 26 for added comfort to the user. The shape of this arm rest 27 may be a simple rectangle, as shown, or may be styled as illustrated in FIGS. 13 and 14 as an alternate configuration, at any rate the arm rest is built into the arm 26 as an integral component.

A mattress support structure 34 may be in the form of a so called bunkey board 34*a* that is disposed between the ends 22 and lower longitudinal supports 30 and sustained by the angular structure of the supports themselves. The bunkey board 34*a* is normally comprised of a sheet of plywood however other similar material may be easily substituted.

A mattress 36 is positioned upon the bunkey board 34*a* and forms a comfortable seat for sitting on the front portion as well as a bed when the entire surface is used. The mattress 36 preferably includes a covering of upholstery material for durability and to add to the overall attractiveness of the couch. The covering may be formed integrally with the mattress 36 or may be at separate wrapper that is encompasses the entire mattress attached with a zipper closure. It has been found that a mattress 36 of a conventional twin bed size is ideal for the application and is easily procured and well known in the art.

Figure 11:
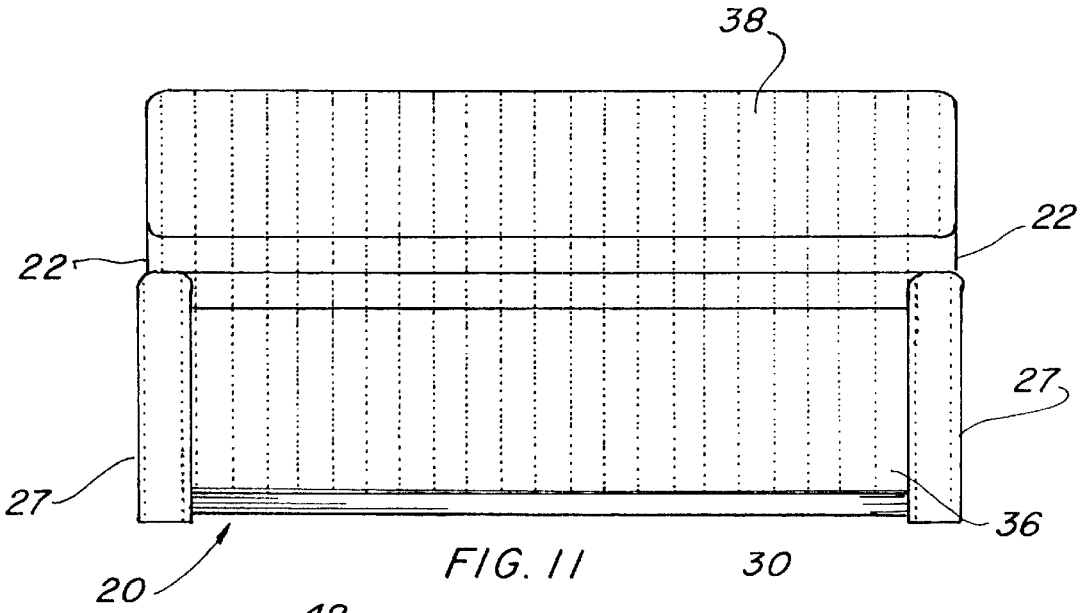
FIG. 11 is a top plan view of the preferred embodiment in the couch configuration.
Figure 12:
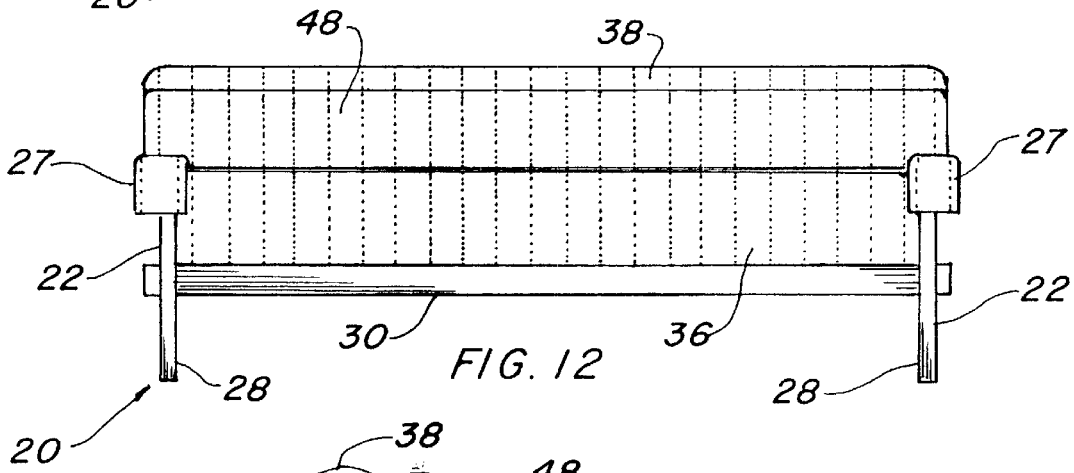
FIG. 12 is a front elevational view of the preferred embodiment in the couch configuration.

An upholstered top 38 is positioned directly above and covers a rear portion of the mattress 36 as illustrated in FIGS. 1, 11 and 12. The top 38 has a front edge 40 and a rear edge 42 with the top rear edge 42 hingeably attached to the frame upper longitudinal support 32. The top 38 is flush with the frame end horizontal upper surface 24 when it is pivotally attached as depicted in FIGS. 3 through 6.

The hingeable attachment preferably consists of a first piano hinge 44 that is attached to both the rear edge 42 of the top 38 and to the frame upper longitudinal support 32 as illustrated in FIGS. 3 through 6. While a piano hinge has proven to be ideal any leaf hinge would also function in a suitable manner.

The upholstered top 38 further includes a layer of open cell foam 46, having a thickness of at least 1 inch (2.54 cm), and is then covered by upholstery material in the usual manner well known in the art. The foam material may be flat, as shown, or have some type of shape that would add to the aesthetics of the couch.

An upholstered back 48 includes an upper edge 50 and a lower edge 52 with the upper edge 50 hingeably attached to the front edge 40 of the top 38 such that the back 48 may fold upward in accordion fashion in concert with the top 38. The lower edge 52 may rest upon the horizontal upper surface 24 of each frame end 22 permitting conversion of the couch into a bed by exposing the entire mattress 36 forming a bed suitable for sleeping.

The upholstered back 48 further includes a block of open cell foam 54 having a thickness of at least 2.5 inches (6.35 cm) at the thickest point, also the back 48 is covered by upholstery material preferably of the same type as used to cover the mattress 36. This block of foam 54 may be flat with square comers or may be radiused to round off the exposed comers, likewise the material may include a bead on the sharp edges or simply follow the contour of the foam 54. Again the shape may vary to make a comfortable backrest and to follow the overall design of the entire of the couch. For comfort of the user the upholstered back 48 is angled from 10 to 30 degrees from vertical and may be flat or curved to follow the shape of ones spine.

The hingeable attachment for the back 48 consists of a second piano hinge 56 that is attached to both the back upper edge 50 and to the front edge of the top 40 as illustrated in FIGS. 3 through 6. Again a piano hinge has functioned best but it should not be limited to this type only.

Figure 3:
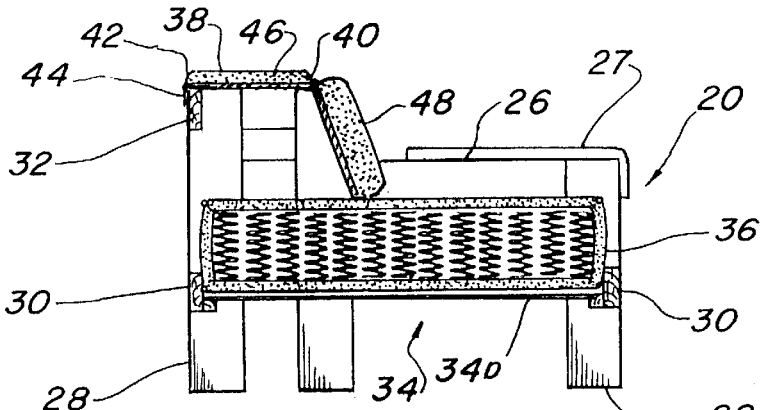
FIG. 3 is a cross sectional view taken along lines 3—3 of FIG. 1 in the couch configuration for sitting.
Figure 4:
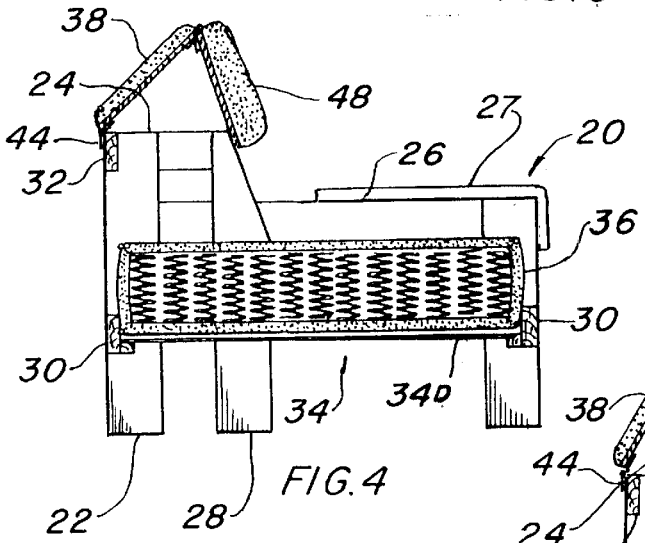
FIG. 4 is a cross sectional view taken along lines 4—4 of FIG. 1 with the top and back partially raised up.
Figure 5:
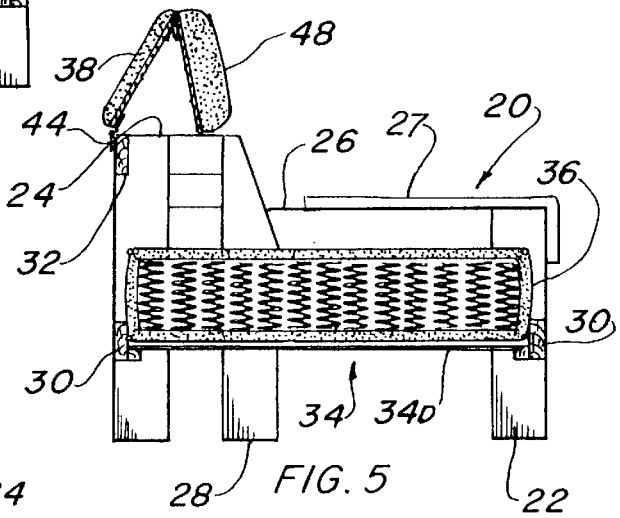
FIG. 5 is a cross sectional view taken along lines 5—5 of FIG. 1 with the top and back raised up almost to the vertical position.
Figure 6:
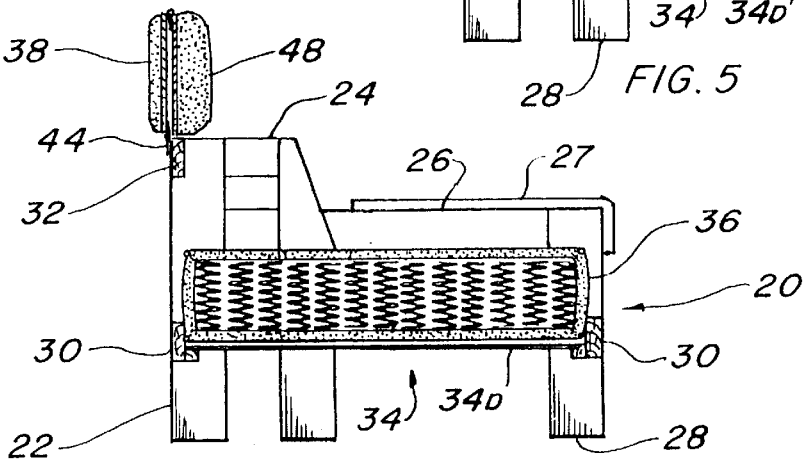
FIG. 6 is a cross sectional view taken along lines 6—6 of FIG. 1 with the top and back raised up in the vertical position for the bed configuration.
Figure 7:
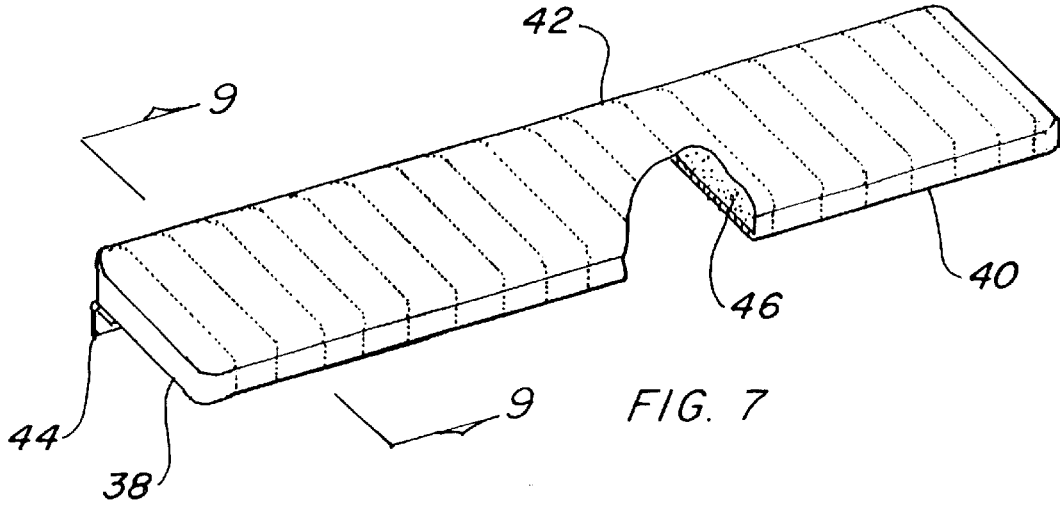
FIG. 7 is a partial isometric view of the upholstered top completely removed form the couch for clarity.
Figure 8:
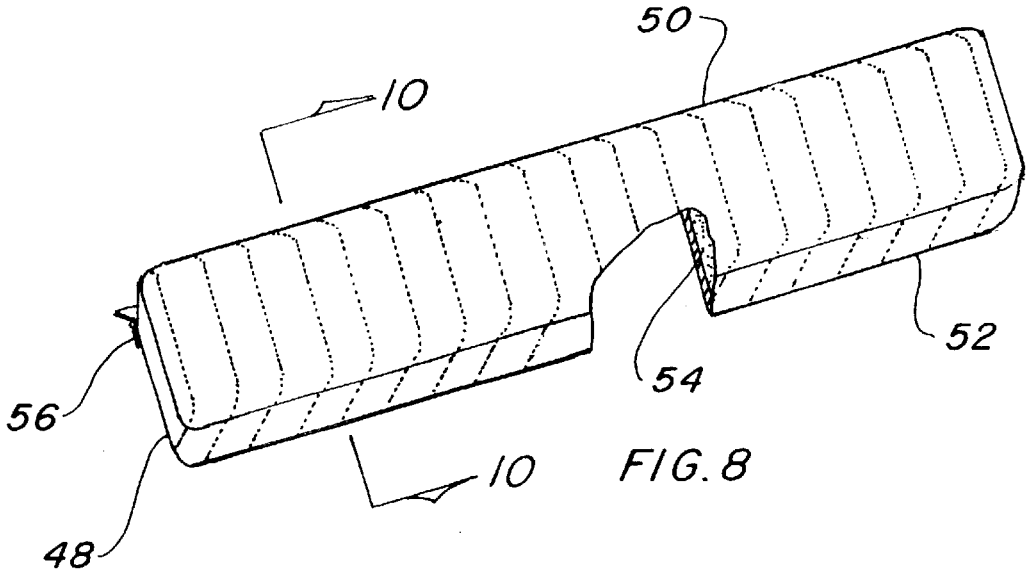
FIG. 8 is a partial isometric view of the upholstered back completely removed form the couch for clarity.
Figure 9:
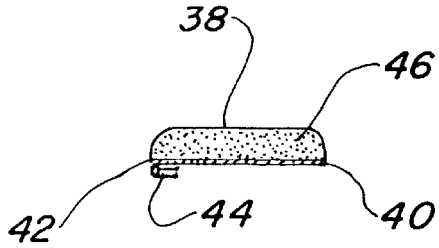
FIG. 9 is a cross sectional view taken along lines 9—9 of FIG. 7.
Figure 10:
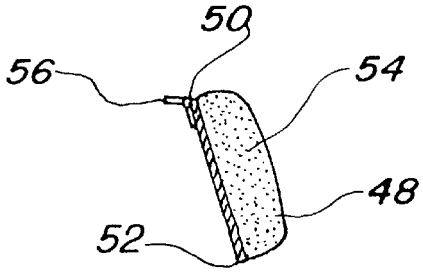
FIG. 10 is a cross sectional view taken along lines 10—10 of FIG. 8.

To operate the couch in changing its utility the user simply grasps the lower edge 52 of the back 48 and pulls upwardly which folds the back 48 into the top 38 until the two sandwich together and come to rest in the vertical position. FIGS. 3 through 5 illustrate this action in cross section with FIG. 3 showing the couch in the sitting position, FIGS. 4 and 5 progressively moving upward and FIG. 6 finally depicting the top 38 and back 48 nested together in the bed configuration.

It should be noted that the preferred embodiment is illustrated in FIGS. 1 through 12 however FIGS. 13 and 14 show a slight variation in the overall appearance of the couch with completely upholstered ends 22 and overstuffed arm rests 27 as the design may easily include all of the conventional features of today's design trends.

The second embodiment is shown in FIGS. 15 through 23 and differs in that the mattress is in two separate sections forming a king size bed when folded out flat in front of the couch, with the remainder of the top and back unchanged.

Figure 21:
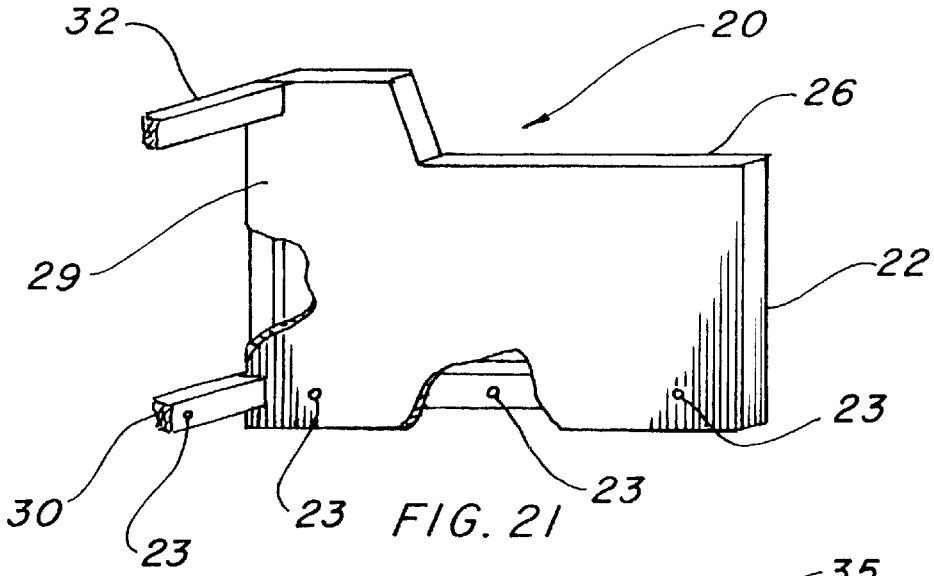
FIG. 21 is a fragmentary partial isometric view of the second embodiment end cut away to show the interior construction.
Figure 22:
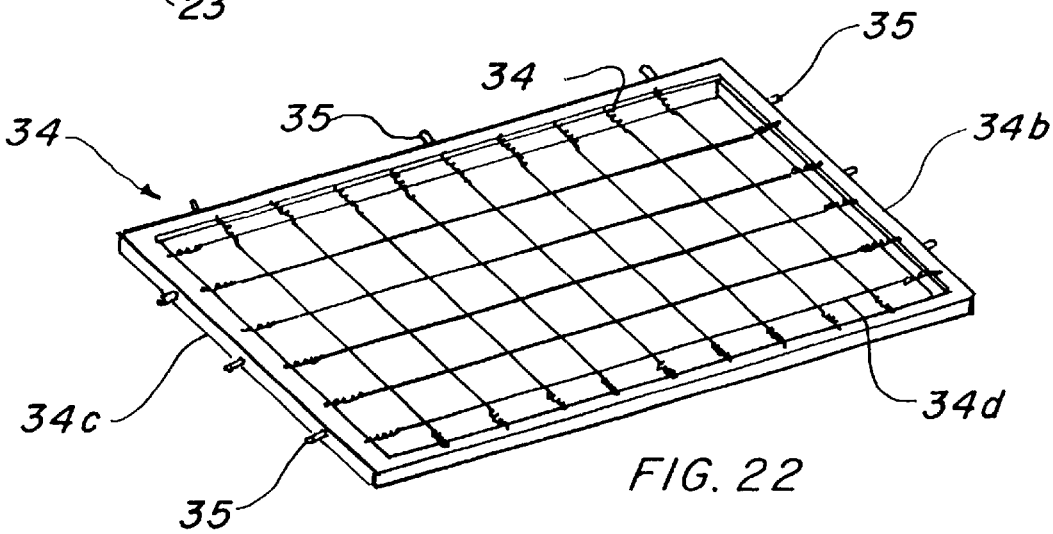
FIG. 22 is a partial isometric view of the mattress support structure in the form of a metallic frame bed springs.

The frame 20 is also basically the same except the ends 22 are formed with the legs 28 enclosed within plywood facing 29 as depicted in FIG. 21. While this change is selected for this embodiment it may also be used in the preferred embodiment as well and vis-à-vis.

The mattress support structure 34 in this embodiment is consists of a metallic frame bed springs 34*b* which have a rectangular angle frame 34*c* with a matrix of intermeshed wires 34*d* between extension springs 34*e* attached directly to the angle frame. The bed springs 34*b* are shown by itself in FIG. 22 and are well known in the art in this form however the frame 34*c* has been altered to include a plurality of studs 35 on the outside surface to attach to the ends 22 of the frame 20. It is preferred that the ends 22 have countersunk holes 23 forming sockets to receive the necessary hardware such as nuts and washers while maintaining a smooth outside surface and yet being accessible for disassembling the couch. Again it should be noted that this type of construction may be used in the preferred embodiment as well.

The mattress 36 in this second embodiment is made in two separate sections a bottom section 36*a* and a top section 36*b* each having dimensions of a conventional twin bed size and hingeably attached together with a flexible hinge 36*c* on one longitudinal side such that they are positioned one on top of the other when acting as a seat and when pivoted to a side by side flat position forming a king size bed (known as a California King which is the combined size of two twin beds). To compensate for the structural differences the bottom section 36*a* is thinner than the top section 36*b* as shown in the cross sections of FIGS. 17 and 20 however the remainder of the dimensions are the same as a twin bed mattress.

Figure 23:
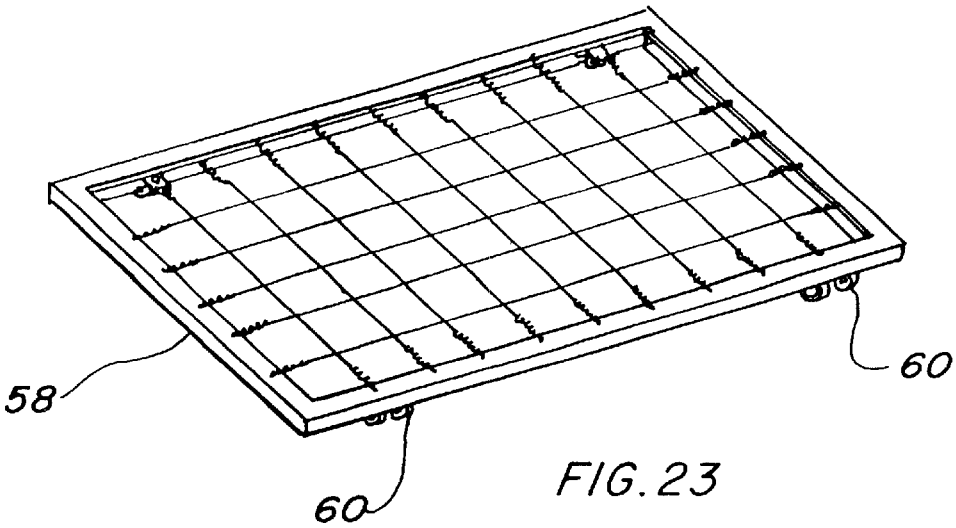
FIG. 23 is a partial isometric view of the second embodiment portable metallic frame bed springs.

A portable metallic frame bed spring 58 is stored under the mattress support structure 34 such that the bed spring 58 may be manually slid in front of the convertible couch bed to receive and support the extending section 36*b* of the mattress 36. This portable metallic frame bed spring 58 consists of the same basic structure as the rectangular angle frame 34*b* including a matrix of intermeshed wires 34*d* between extension springs 34*e* that are attached directly to the angle frame 58. A plurality of casters 60 are disposed on the angle frame of the portable metallic frame bed spring 58 for ease of movement of the frame from under the couch when extending the mattress therefrom. FIG. 23 illustrates this portable metallic frame bed spring 58 by itself.

It will be noted that the balance of the elements used in the second embodiment are identical to the preferred embodiment including the top 38 and back 48 along with its basic and alternative structure.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A convertible couch bed comprising:

a) a frame, having a pair of opposed ends with each end having a horizontal upper surface and an arm, said frame further having an upper longitudinal support between the ends adjacent to the upper surface, b) a mattress support structure disposed between and attached to the ends for sustaining the structural integrity of the frame in conjunction with the upper longitudinal support, c) a mattress positioned upon the mattress support structure forming a comfortable seat for sitting on a top portion thereof, d) an upholstered top directly above and covering a rear portion of the mattress, said top having a front edge and a rear edge with the top rear edge hingeably attached to the frame upper longitudinal support, e) an upholstered back having a upper edge and a lower edge with the upper edge of the back hingeably attached to the front edge of the top such that the back may fold upward in accordion fashion in concert with the top and the lower edge may rest upon the horizontal upper surface of each frame end permitting conversion of the couch into a bed by exposing the entire mattress therefore forming a bed suitable for sleeping, and f) said top rear edge attached to the frame upper longitudinal support and said upper edge of the back hingeably attached to the front edge of the top defined as, a first piano hinge attaching the top rear edge to the frame upper longitudinal support and a second piano hinge attaching the back to the front edge of the top.

2. The convertible couch bed as recited in claim 1 wherein said mattress support structure further comprises a metallic frame bed spring.

3. A convertible couch bed comprising:

a) a frame, having a pair of opposed ends with each end having a horizontal upper surface and an arm, said frame further having an upper longitudinal support between the ends adjacent to the upper surface, b) a mattress support structure disposed between and attached to the ends for sustaining the structural integrity of the frame in conjunction with the upper longitudinal support, wherein said mattress support structure further comprises a pair of lower longitudinal supports retaining a bunkey board in the form of a sheet of plywood, c) a mattress positioned upon the mattress support structure forming a comfortable seat for sitting on a top portion thereof, d) an upholstered top directly above and covering a rear portion of the mattress, said top having a front edge and a rear edge with the top rear edge hingeably attached to the frame upper longitudinal support, and e) an upholstered back having a upper edge and a lower edge with the upper edge of the back hingeably attached to the front edge of the top such that the back may fold upward in accordion fashion in concert with the top and the lower edge may rest upon the horizontal upper surface of each frame end permitting conversion of the couch into a bed by exposing the entire mattress therefore forming a bed suitable for sleeping.

4. A convertible couch bed comprising:

a) a frame having a pair of opposed ends with each end having a horizontal upper surface and an arm, said frame further having an upper longitudinal support between the ends adjacent to the upper surface, b) a mattress support structure disposed between and attached to the ends for sustaining the structural integrity of the frame in conjunction with the upper longitudinal support, said mattress support structure further comprises a metallic frame bed spring, said metallic frame bed spring further comprises, a rectangular angle frame having a matrix of intermeshed wires between extension springs that are attached directly to the angle frame, c) a mattress positioned upon the mattress support structure forming a comfortable seat for sitting on a top portion thereof, d) an upholstered top directly above and covering a rear portion of the mattress, said top having a front edge and a rear edge with the top edge hingeably attached to the frame upper longitudinal support, e) an upholstered back having a upper edge and a lower edge with the upper edge of the back hingeably attached to the front edge of the top such that the back may fold upward in accordion fashion in concert with the top and the lower edge may rest upon the horizontal upper surface of each frame end permitting conversion of the couch into a bed by exposing the entire mattress therefore forming a bed suitable for sleeping, and f) said top rear edge attached to the frame upper longitudinal support and said upper edge of the back hingeably attached to the front edge of the top defined as, a first piano hinge attaching the top rear edge to the frame upper longitudinal support and a second piano hinge attaching the back to the front edge of the top.

5. The convertible couch bed as recited in claim 4 wherein said ends are detachable from the longitudinal support and mattress support structure for ease of transportation and storage.

6. The convertible couch bed as recited in claim 4 wherein said arms further comprise, a padded and upholstered arm rest disposed on each frame arm.

7. The convertible couch bed as recited in claim 4 wherein said mattress further includes a covering of upholstery material.

8. The convertible couch bed as recited in claim 4 wherein said mattress is of a conventional twin bed size.

9. The convertible couch bed as recited in claim 4 wherein said upholstered top is flush with the frame end horizontal upper surface.

10. The convertible couch bed as recited in claim 4 wherein said upholstered top further having open cell foam with a thickness of at least 1 inch (2.54 cm) covered by upholstery material.

11. The convertible couch bed as recited in claim 4 wherein said upholstered back further having open cell foam with a thickness of at least 2.5 inches (6.35 cm) covered by upholstery material.

12. The convertible couch bed as recited in claim 4 wherein said upholstered back is angled from 10 to 30 degrees from vertical for seating comfort.

13. A convertible couch bed comprising:

a) a frame, having a pair of opposed ends with each end having a horizontal upper surface and an arm, said frame further having an upper longitudinal support between the ends adjacent to the upper surface, b) a mattress support structure disposed between and attached to the ends for sustaining the structural integrity of the frame in conjunction with the upper longitudinal support, c) a mattress positioned upon the mattress support structure forming a comfortable seat for sitting on a top portion thereof, said mattress is in two separate sections each having dimensions of a conventional twin bed size and hingeably attached together on one longitudinal side such that they are positioned one on top of the other when acting as a seat and when pivoted to a side by side flat position forming a king size bed, d) an upholstered top directly above and covering a rear portion of the mattress said top having a front edge and a rear edge with the top rear edge hingeably attached to the frame upper longitudinal support, e) an upholstered back having a upper edge and a lower edge with the upper edge of the back hingeably attached to the front edge of the top such that the back may fold upward in accordion fashion in concert with the top and the lower edge may rest upon the horizontal upper surface of each frame end permitting conversion of the couch into a bed by exposing the entire mattress therefore forming a bed suitable for sleeping, f) said top rear edge attached to the frame upper longitudinal support and said upper edge of the back hingeably attached to the frame edge of the top defined as, a first piano hinge attaching the top rear edge to the frame upper longitudinal support and a second piano hinge attaching the back to the front edge of the top, and g) portable metallic frame bed springs stored under said mattress support structure such that the bed springs may be manually slid in front of the convertible couch bed to receive and support the mattress extending section.

14. The convertible couch bed as recited in claim 13 wherein said portable metallic frame bed springs further comprise, a) a rectangular angle frame having a matrix of intermeshed wires between extension springs that are attached directly to the angle frame, and b) a plurality of casters disposed on the angle frame for ease of movement of the frame from under the couch when extending the mattress therefrom.

15. A convertible couch bed comprising:

a frame, having a pair of opposed ends and longitudinal support means for spacing the ends apart, a mattress support structure disposed between the ends and longitudinal support means, a mattress positioned upon the support structure forming a comfortable seat for sitting on a top portion thereof, said mattress having two separate sections each having dimensions of a conventional twin bed size and hingeably attached together on one longitudinal side such that they are positioned one on top of the other when acting as a seat and when pivoted to a side by side flat position forming a king size bed, and portable metallic frame bed springs stored under said mattress support structure such that they may be manually moved in front of the couch bed to receive and support the mattress extending section, a top directly above and covering a rear portion of the mattress, said top having a front edge and a rear edge with the top rear edge hingeably attached to the frame upper longitudinal support means, a back having a upper edge and a lower edge with the upper edge of the back hingeably attached to the front edge of the top such that the back may fold upward in accordion fashion in concert with the top and the lower edge may rest upon the frame permitting conversion of the couch into a bed by exposing the entire mattress therefore forming a bed suitable for sleeping, and said top rear edge hingeably attached to the frame upper longitudinal support means and said upper edge of the back hingeably attached to the front edge of the top defined as, a first piano hinge attaching the top rear edge to the frame upper longitudinal support and a second piano hinge attaching the back to the front edge of the top.

* * * * *